United States Patent [19]

Kajiwara

[11] Patent Number: 4,577,954

[45] Date of Patent: Mar. 25, 1986

[54] TWO-COLOR COPYING APPARATUS

[75] Inventor: Norio Kajiwara, Ichikawa, Japan

[73] Assignee: Ricoh Company, Ltd., Japan

[21] Appl. No.: 586,672

[22] Filed: Mar. 6, 1984

[30] Foreign Application Priority Data

Mar. 7, 1983 [JP] Japan ..... 58-36010

[51] Int. Cl.[4] ..... G03G 15/01

[52] U.S. Cl. ..... 355/4; 355/3 R; 118/645; 430/44; 430/54

[58] Field of Search ..... 355/4, 3 R, 32, 35, 355/77; 350/166, 397, 398, 439; 118/645; 430/42, 44, 54

[56] References Cited

U.S. PATENT DOCUMENTS

| | | | |
|---|---|---|---|
| 3,667,841 | 6/1972 | Ross | 355/4 X |
| 3,690,756 | 9/1972 | Smith | 355/4 |
| 4,371,253 | 2/1983 | Day et al. | 355/4 |
| 4,428,662 | 1/1984 | Day | 355/4 |

*Primary Examiner*—A. C. Prescott

*Attorney, Agent, or Firm*—Guy W. Shoup

[57] ABSTRACT

A two-color copying apparatus has a half reflecting mirror located posterior to an image forming lens in the path of a light beam for splitting a light beam reflected by an original in black and a chromatic color for development of corresponding latent images on respective photoconductive drums and printing on a transfer-printing sheet conveyed by a conveyor belt and successively brought into contact with the outer circumferential surfaces of the drums. The sub-beam of light reflected by the half reflecting mirror and the sub-beam of light transmitted through the half reflecting mirror serve as a chromatic color image forming sub-beam of light and a black image forming sub-beam of light, respectively, which are projected on to quadrants on the outer circumferential surfaces of the two drums located on opposite sides of the drums with respect to imaginary vertical lines extending through the centers of the respective drums which are remote from the positions in which the transfer-printing sheet is brought into contact with the drums.

7 Claims, 1 Drawing Figure

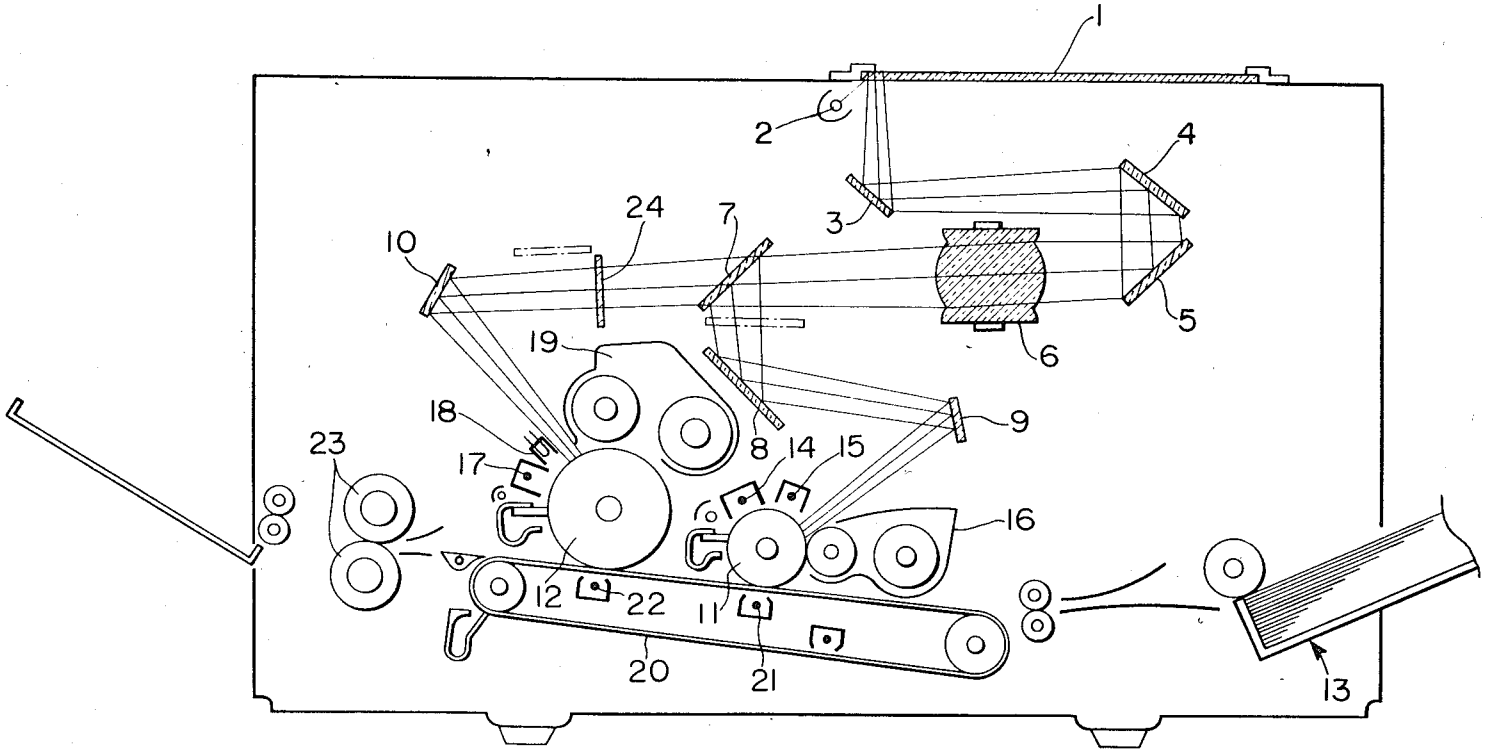
1
2
3
4
5
6
7
8
9
10
11
12
13
14
15
16
17
18
19
20
21
22
23
24

TWO-COLOR COPYING APPARATUS

BACKGROUND OF THE INVENTION

This invention relates to a two-color copying apparatus suitable for use as office equipment for producing from a document or picture in two colors, including black and red or other chromatic color, a copy or copies of the document or picture in the same colors.

When it is desired to produce a copy of a painting or picture in color by using a color copying apparatus, it is necessary that the copy or copies produced have the same color tone and contrast as the original. In this case, beams of light obtained by passing an optical image of the original through a three color separators of blue, green and red color separators are used to successively expose one and the same photosensitive member thereto to obtain three discrete latent images which are successively developed into visible images by using three different kinds of toners or toners of yellow, magenta and cyan in color. The visible images obtained in this way are successively printed in overlapping relation by transfer printing in a transfer-printing sheet which is wound on a transfer printing drum to obtain a copy of the original in original colors.

Some disadvantages are associated with this type of color copying apparatus. Difficulties would be experienced in achieving a delicate balance in the density of toner images of different colors, and highly advanced techniques would be required for precisely and accurately superposing the toner images one over another on a transfer-printing drum. Thus, it would require operators of high skills to perform the operation of producing the desired copy or copies in the same color as the original and the operation itself would be time-consuming and high in cost.

Meanwhile, documents handled in offices, such as memorandums on business transactions or reports on research are generally in black ink. However, it sometimes happens that lines are drawn in red beneath some letters or sentences or around some drawing figures to draw attention thereto. If it is possible to produce a copy or copies of such documents in two colors or black and red, for example, the trouble of coloring a monochrome copy could be eliminated. In this case, it is not necessary that the color tone and contrast obtained in the color copy be exactly the same as in the original as is the case with copying a painting or color picture as described hereinabove, and the image in red need not necessarily be high in resolution.

To this end, proposals have been made to use a two-color copying apparatus of the type which comprises a half reflecting mirror located posterior to an image forming lens of an original exposing and scanning optical system to split a beam of light reflected by an original into a sub-beam reflected by the half reflecting mirror and a sub-beam transmitted through the half reflecting mirror. The sub-beams of light obtained by using the half reflecting mirror are projected on to surfaces of separate photosensitive members to expose them to form on each photosensitive member by a predetermined process an electrostatic latent image having image regions corresponding to regions of the original which are black in color and image regions corresponding to regions of the original which are red or any other chromatic color. The black image regions of each electrostatic latent image are developed by using a black toner and the image regions thereof of other color than black are developed by using a toner of that color, and the toner images formed on the two photosensitive members are successively printed by transfer-printing in overlapping relation on transfer-printing sheets successively fed to a developing station while they are kept in contact with the surfaces of the photosensitive members.

In an original image forming optical system using mirrors, the resolution of an image forming surface may vary depending on the flatness of the surface of the mirrors. Particularly when the mirror is located in the vicinity of the lens of the optical system, the resolution is greatly affected by the flatness of the surface of the mirror. The half reflecting mirror described hereinabove is located immediately posterior to the image forming lens. Thus, if the half reflecting mirror were low in flatness, the image forming surface would have reduced resolution with respect to the sub-beam of light reflected by the half reflecting mirror. A reduction in resolution would be marked when it is desired to obtain a copy in a smaller size than the original.

Meanwhile, the sub-beam of light transmitted through the half reflecting mirror is impervious to influences exerted by a medium (glass of the half reflecting mirror), so that the use of the half reflecting mirror causes no appreciable reduction in the resolution of the image forming surface.

In the two-color copying apparatus of the construction referred to hereinabove, the toner images are printed by transfer-printing from the photosensitive members on transfer-printing sheets which are successively fed to the photosensitive members in such a manner that the image regions of black color and chromatic color are disposed on each copy produced in the same positional relation as in the original. Consequently, the two photosensitive members are spaced apart from each other a small distance, and difficulties might be experienced in arranging various units of the electrophotographic copying apparatus around the two photosensitive members depending on the positions in which the two sub-beams of light are projected on to the surfaces of the photosensitive members to form electrostatic latent images thereon.

SUMMARY OF THE INVENTION

This invention has been developed for the purpose of obviating the aforesaid disadvantages of the two-color copying apparatus of the prior art in which the half reflecting mirror is located in the path of a beam of light in the exposing optical system. Accordingly, the invention has as one of its objects the provision of a two-color copying apparatus of the type described which is capable of producing two-color copies of an orginal of sufficiently high quality to serve the purpose of use.

Another object is to provide a two-color copying apparatus of the type described in which various units of the copying apparatus can be arranged in the vicinity of the two photosensitive drums without any trouble.

According to the invention, two sub-beams of light obtained by splitting a beam of light bearing an optical image of the original by using a half reflecting mirror are used in such a manner that a sub-beam of light transmitted through the half reflecting mirror serves as a black image forming light beam and a sub-beam of light reflected by the half reflecting mirror serves as a chromatic color image forming light beam, whereby two-color copies of an original obtained as the end products can have a sufficiently high quality to serve the purpose of use as office documents.

According to the invention, the black image forming light beam and chromatic color image forming light beam are projected on to surfaces of two photosensitive drums having substantially parallel axes and spaced apart from each other a small distance in positions which are located on quadrants of the two photosensitive drums, respectively, extending in directions moving away from each other by starting at points each located on the outer circumference of the respective photosensitve drum in a position diametrically opposed to a position on the outer circumference in which a conveyor belt for conveying transfer-printing sheets is in contact with the respective photosensitive drum, thereby enabling various units of the copying apparatus to be arranged in the vicinity of the two photosensitive drums without any trouble.

BRIEF DESCRIPTION OF THE DRAWING

The single drawing copy is a schematic sectional view of a two-color copying apparatus in which the invention is incorporated.

DESCRIPTION OF THE PREFERRED EMBODIMENT

A preferred embodiment of the invention will now be described by referring to the accompanying drawing.

The two-color copying apparatus comprises a contact glass member 1 on which an original to be copied, which may be a document, drawing or any other typed or printed matter, is placed is irradiated by an exposing lamp 2. The original thus irradiated reflects a light beam from the exposing lamp 2, and a light beam bearing an optical image of the original enters an exposing optical system of the copying apparatus. More specifically, the light beam is successively reflected by a first mirror 3, a second mirror 4 and a third mirror 5 and passes through an image forming lens 6 before reaching a half reflecting mirror 7 which is located in a path of light beam posterior to the image forming lens 6. At the half reflecting mirror 7, the light beam is split into a sub-beam of light reflected by the mirror 7 and a sub-beam of light transmitted through the mirror 7. The sub-beam of light reflected by the mirror 7 is further reflected by a fourth mirror 8 and a fifth mirror 9 before being projected on to an outer circumferential surface of a first photosensitive drum 11 to expose the surface to form an electrostatic latent image of the original thereon. Meanwhile, the sub-beam of light transmitted though the mirror 7 is reflected by a sixth mirror 10 and then projected on to an outer circumferential surface of a second photosensitive drum 12 to expose the surface to form an electrostatic latent image of the original thereon.

In this specification, the first photosensitive drum 11 having the sub-beam of light reflected by the half reflecting mirror 7 projected on to its outer circumferential surface shall be referred to as a red image forming photosensitive drum and the second photosensitive drum 12 having the sub-beam of light transmitted through the half reflecting mirror 7 projected on to its outer circumferential surface shall be referred to as a black image forming photosensitive drum.

A red color filter 24 is removably inserted in the path of light beam between the image forming lens 6 and sixth mirror 10, so that the black image forming photosensitive drum 12 will be exposed to the sub-beam of light in red color to form an image thereon and prevented from forming an image of red regions of the original. The red image forming photosensitive drum 11 is constructed such that its surface is essentially charged only when it is exposed to the sub-beam of light in red color.

When the sub-beams of light from the half reflecting mirror 7 are projected on to the outer circumferential surfaces of the red image forming photosensitive drum 11 and black image forming photosentive drum 12 respectively, an electrostatic latent image having regions corresponding to red regions of the original and an electrostatic latent image having regions corresponding to black regions of the original are formed on the respective image forming sections of the outer circumferential surfaces of the drums 11 and 12. The electrostatic latent images on the drums 11 and 12 are developed by toners of the respective color into toner images of red and black colors respectively by a process performed by various units of the two-color copying apparatus. More specifically, a primary charging unit 14, a secondary charging unit 15 and a red color image developing unit 16 are located around the red image forming photosensitive drum 11 for forming a red toner image thereon. A charging unit 17, a greenlight emitting diode eraser 18 and a black image developing unit 19 are located around the black image forming photosensitive drum 12 for forming a black toner image.

Transfer-printing sheets fed from a transfer-printing sheet feeding tray 13 are successively conveyed by a conveyor belt 20 and brough into contact with the red toner image and black toner image on the outer circumferential surfaces of the red image forming photosensitive drum 11 and black toner image forming photosensitive drum 12, respectively, which have substantially parallel axes. When each transfer-printing sheet is indexed with the red toner image and black toner image successively, chargers 21 and 22 disposed opposite the drums 11 and 12 repestively with respect to the conveyor belt 20 are actuated to print the red toner image and black toner image on the transfer-printing sheets by transfer-printing techniques. In order that the red and black toner images may be printed on each transfer-printing sheet in the same positional relation as in the original, the distance between the positions of the chargers 21 and 22 in which transfer-printing is carried out is set to be equal to a circumferential extent of the black image forming photosensitive drum 12 from the position in which the outer circumferential surface of the drum 12 is exposed to the sub-beam of light for black image to the position of transfer-printing 21 minus a circumferential extent of the red image forming photosensitive drum 11 from the position in which the outer circumferential surface of the drum 11 is exposed to the sub-beam of light for red image to the position of transfer-printing 21. After having the red and black toner images printed thereon, each transfer-printing sheet has the printed image fixed by a fixing unit 23, before being ejected from the copying apparatus.

According to the invention, the first photosensitive drum 11 in which a reduction in resolution of the image forming surface is inevitable due to the fact that an electrostatic latent image is formed thereon by the sub-beam of light reflected by the half reflecting mirror 7 is used as a red image forming photosensitive drum, and the second photosensitive drum 12 which is substantially free from the risk of developing a reduction in resolution of its image forming surface because of the fact that an electrostatic latent image is formed thereon by the sub-beam of light transmitted through the half reflecting mirror 7 is used as a black image forming photosensitive drum. As a result, the black image of the original which is an information bearing image is free from the risk of being affected by a reduction in resolution of the image forming surface when the copies produced are smaller in size than the original. Meanwhile, the red image may be affected by a reduction in resolution of the image forming surface, but the influences exerted by the reduction in resolution are not serious because the red image usually serves the purpose of marking a paragraph or a sentence or a drawing figure of a document for attracting the attention of readers.

Thus, by virture of the aforesaid feature, the two-color copying apparatus incorporating the invention is capable of producing copies in two colors of black and red which serve the purpose of use as office document.

The invention offers the following advantages. When it is desired to produce copies in black and white by using the two-color copying apparatus according to the invention, a reduction in the degree of illumination would occur if the half reflecting mirror 7 remained set in the position shown in the drawing figure. By removing the half reflecting mirror 7, it is possible to increase the intensity of illumination to thereby improve the copying speed or reduce the amount of light emanating from the light source. In this case, the red color filter 24 is, also removed to allow light of all colors to reach the second photo-sensitive drum 12. If the sub-beam of light reflected by the half reflecting mirror 7 were black image forming light beam, it would be necessary not only to remove the half reflecting mirror 7 but also to insert a total reflecting mirror in the position in which the half reflecting mirror 7 is located. This would result in a complication of mechanism, an increase in cost and a reduction in reliablity.

The two photosensitive drums 11 and 12 are spaced apart from each other a relatively small distance. However, the arrangement of the various units, particularly the developing unit which occupies a large space, is facilitated if the position on the outer circumferential surface of the red image forming photosensitive drum 11 on to which the image forming sub-beam of light from the half reflecting mirror 7 is projected is set on a first quadrant determined by using the center of the drum 11 as the origin of coordinates and the position on the circumference of the black image forming photosensitive drum 12 on to which the image forming sub-beam of light from the half reflecting mirror 7 is projected is set on a second quadrant determined by using the center of the drum 12 as the origin of coordinates. The aforesaid first quadrant of the circumference of the red image forming photosensitive member 11 extends rightwardly in the drawing figure with respect to vertical line extending through the center of the drum 11 which is remote from the position in which the sheet is brought into contact with the drum 11. The aforesaid second quadrant of the circumference of the black image forming photosensitive member 12 extends leftwardly in the drawing figure with respect to vertical line extending through the center of the drum 12 which is remote from the position in which the sheet is brought into contact with the drum 12.

What is claimed is:

1. A two-color copying apparatus for producing copies in two colors from an original having regions of black color and regions of a second color which is a chromatic color, comprising two photosensitive drums having substantially parallel axes and located adjacent each other, one of the two photosensitive drums serving as a chromatic color image forming photosensitive drum and the other photosensitive drum serving as a black image forming photosensitive drum, and an exposing optical system having an image forming lens, and a half reflecting mirror located in a path of light beam posterior to said image forming lens, said half reflecting mirror being operative to split a light beam reflected by the original into two sub-beams of light which are projected on to outer circumferential surfaces of said two photosensitive drums in two predetermined positions of the respective drums to form electrostatic latent images corresponding to the regions of the chromatic color and the image regions of black color respectively of the original, said electrostatic latent image having the image regions of the chromatic color being developed by using a toner of the chromatic color to form a toner image of the chromatic color on an outer circumferential surface of the chromatic color image forming photosensitive drum and said electrostatic latent image having the image regions of black color image being developed by using a toner of black color to form a toner image of black color on an outer circumferential surface of the black image forming photosensitive drum, said toner image of the chromatic color and said toner image of black color being successively printed by transfer-printing in overlapping relation on a transfer-printing sheet conveyed by a conveyor belt and brought into contact with the outer circumferential surfaces of the two photosensitive drums in such a manner that the image regions of the chromatic color and the image regions of black color of the toner images printed on the photosensitive sheet have substantially the same positional relations to the regions of the chromatic color and the regions of black color of the original to thereby produce a copy of the original in two colors, wherein the improvement resides in that:

one of said two sub-beams of light obtained by splitting the light beam reflected by the original which is reflected by said half reflecting mirror serve only as a chromatic color image forming sub-beam of light and the other sub-beam of light transmitted tnrough said half reflecting mirror serves as the black image forming sub-beam of light.

2. A two-color copying apparatus as claimed in claim 1, wherein said predetermined positions in the outer circumferential surfaces of said two photo-sensitive drums on which said chromatic color image forming sub-beam of light and black color image forming sub-beam of light are projected, respectively, are located on quadrants of the circumferences of the two photosensitive drums located on opposite sides of the photosensitive drums with respect to imaginary vertical lines extending through the centers of the respective photosensitive drums at right angles to the positions in which the transfer-printing sheet is brought into contact with the photosensitive drums which are remote from the positions in which said transfer-printing sheet is brought into contact with the two photosensitive drums.

3. A two color copying apparatus as claimed in claim 1, wherein said half reflecting mirror is movable out of the path of the light beam to effect printing on the sheet in the black color only.

4. A two color copying apparatus as claimed in claim 2, wherein the chromatic color drum is of reduced scale compared to the black color drum, and the two drums are spaced apart a distance equal to the difference of the distance from the circumferential position on the black color drum where said black color image sub-beam is projected to its sheet contact point and the distance from the opposing circumferential position on the chromatic color drum where said chromatic color image sub-beam is projected to its sheet contact point.

5. A two color copying apparatus for producing a copy from an original document having primary information in a black color requiring high resolution copying and secondary information highlighted in a chromatic color requiring lower resolution copying, comprising:

a document station and means for illuminating an original document thereon to produce a light image therefrom;

means including a half reflecting mirror for dividing said light image by transmitting therethrough without distortion a sub-beam carrying the black color primary information and only reflecting therefrom a sub-beam carrying the chromatic color secondary information;

two photosensitive members arranged in parallel for forming latent toner images thereon corresponding to the black color primary information and the chromatic color secondary information, respectively;

means for projecting the black color sub-beam and the chromatic color sub-beam on predetermined circumferential positions on the respective photosensitive members to form respective latent images thereon, and for developing the respective images with black color toner and chromatic color toner, respectively; and means for transporting a transfer sheet successively in contact with said drums, and means for transferring the developed latent images from the photosensitive members onto said sheet such that the black color primary information toner image and the chromatic color secondary information toner image are printed thereon in the same positional relation as on the original document, in order to thereby produce a copy of the original document in two colors.

6. A two color copying apparatus as claimed in claim 5 wherein said half reflecting mirror is movable out of the path of the light image such that the projecting means projects the light image of the original document to said black color photosensitive member for copying in black color only.

7. A two color copying apparatus as claimed in claim 5, wherein the photosensitive members are side-by-side rotating drums, the chromatic color drum is of reduced scale compared to the black color drum, the projecting means projects the sub-beam on respective quadrant positions of each drum opposite from the other relative to vertical lines through the axes of the respective drums and the contact points with the transfer sheet, and the two drums are spaced apart a distance equal to the difference of the distance from the circumferential position on the black color drum where said black color image sub-beam is projected to its sheet contact point and the distance from the opposing circumferential position on the chromatic color drum where said chromatic color image sub-beam is projected to its sheet contact point.

* * * * *